US008928245B2

(12) United States Patent
Wu

(10) Patent No.: US 8,928,245 B2
(45) Date of Patent: Jan. 6, 2015

(54) DRIVING CIRCUIT AND ITS METHOD OF LIGHT EMITTING DIODE

(75) Inventor: Chung-Yu Wu, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 202 days.

(21) Appl. No.: 13/594,597

(22) Filed: Aug. 24, 2012

(65) Prior Publication Data

US 2013/0147384 A1 Jun. 13, 2013

(30) Foreign Application Priority Data

Dec. 9, 2011 (TW) ..... 100145670 A

(51) Int. Cl.
*H05B 41/36* (2006.01)

(52) U.S. Cl.
USPC ..... 315/291; 315/295; 315/308; 315/360

(58) Field of Classification Search
CPC ..... H05B 41/3925; H05B 37/029; H05B 33/0818; H04B 3/36
USPC ..... 315/224, 15, 250, 291, 295, 308, 360; 307/1
See application file for complete search history.

(56) References Cited

U.S. PATENT DOCUMENTS

| | | | | |
|---|---|---|---|---|
| 6,646,654 | B2 | 11/2003 | Takagi | |
| 2011/0115394 | A1 * | 5/2011 | Shteynberg et al. | 315/250 |
| 2012/0049745 | A1 * | 3/2012 | Li et al. | 315/153 |
| 2012/0098328 | A1 * | 4/2012 | Shimomura et al. | 307/1 |

FOREIGN PATENT DOCUMENTS

| | | |
|---|---|---|
| CN | 1162826 | 8/2004 |
| TW | 514866 | 12/2002 |

* cited by examiner

*Primary Examiner* — Thuy Vinh Tran
*Assistant Examiner* — Syed M Kaiser
(74) *Attorney, Agent, or Firm* — Muncy, Geissler, Olds & Lowe, P.C.

(57) ABSTRACT

A driving circuit comprising a control unit, a current control unit, a pulse width modulation control unit and a current driving unit is described. The control unit provides a first control signal and a second control signal. The current control unit is connected to the control unit, and converts a reference current into a plurality of current setting signals based on a data signal and the first control signal. The pulse width modulation control unit is connected to the control unit and outputs a pulse signal based on the data signal and the second control signal. The current driving unit is connected to the pulse width modulation control unit and drives the light emitting diode based on a driving current, wherein the control unit generates a continuous conduction time in a predetermined operation period based on the pulse signal and the current setting signals.

16 Claims, 3 Drawing Sheets

DRIVING CIRCUIT AND ITS METHOD OF LIGHT EMITTING DIODE

CROSS-REFERENCE TO RELATED APPLICATIONS

This non-provisional application claims priority under 35 U.S.C. §119(a) on Patent Application No(s). 100145670 filed in Taiwan, R.O.C. on Dec. 9, 2011, the entire contents of which are hereby incorporated by reference.

BACKGROUND

1. Technical Field

The present disclosure relates to light emitting diodes, and more particularly to driving circuits and their methods for driving light emitting diodes.

2. Related Art

Basically, the brightness level of light emitting diode (LED) changes with current and this characteristic is commonly applied.

A LED element works based on pulse width modulation (PWM). A switch circuit for switching the operation of a LED is connected to the LED, a reference current source and a PWM circuit respectively. If an ON period pulse signal is outputted by the PWM circuit, the switch circuit is at ON (i.e. being turned on), and the LED element will be driven and irradiated by a reference current supplied by the reference current source. If the period of ON level of the pulse signal is lengthened, the luminosity of the LED element will increase accordingly.

In order to reflect the grayscale levels and brightness level of an image, a duty cycle of PWM is changed by the PWM circuit to drive of the LED element, and the duty cycle is a proportion of conduction time of unit in an entire PWM period. In general, the PWM period can not be too long, e.g. can not be longer than 16.6 microseconds, in order to avoid the blinking of a screen from being perceived by human eyes. In order to obtain a wide dynamic range, the shorter duty cycle should be better, e.g. approximately 0.001 microseconds. However, the duty cycle is limited by how fast the circuit can drive.

In general, PWM mechanism is fulfilled by clock-based circuitry, the duty cycle can also be calculated by the designer using a pulse signal (CLK) time, in order to generate a PWM timing period. In order to expand the dynamic range of grayscale level, the signal of brightness level is converted into a binary data which is expressed in two to the Nth power and is designed using a plurality of units of length of time $T_{CLK}$. In the case that N is set to be 16, and then the system is called a 16-bit PWM system. However, the bigger the N is in such a system, the longer is the PWM timing period, and the visual refresh rate becomes slower resulting in a blinking effect presented to human visual sensation. Furthermore, inconsistency will occur between the digital phase and the output of current in the switching between ON and OFF every time, i.e., switching error. The higher a frequency of ON and OFF, the bigger the switching error is.

SUMMARY

The disclosure provides a driving circuit and its method of light emitting diode by which the problems of low visual refresh rate, image blinking and switchover error can be solved.

In one aspect, the present disclose provides a driving circuit comprising a control unit, a current control unit, a pulse width modulation control unit and a current driving unit. The control unit is used for providing a first control signal and a second control signal. The current control unit is connected to the control unit, and is used to convert a reference current into a plurality of current setting signals based on a data signal and the first control signal. The pulse width modulation control unit is connected to the control unit and is used to output a pulse signal based on the data signal and the second control signal. And the current driving unit is connected to the pulse width modulation control unit and used to drive the light emitting diode based on a driving current, wherein the control unit generates a continuous conduction time in a predetermined operation period based on the pulse signal and the current setting signals.

In another aspect, the present disclose provides a driving method for forming a driving current as a plurality of conduction intervals and a plurality of non-conduction intervals based on a plurality of bit codes from the most significant bit to the least significant bit of a data signal, and driving a corresponding light emitting diode in a predetermined operation period. The driving method comprises the following steps: the step of inputting the data signal; the step of sending a first control signal to a current control unit and a second control signal to a pulse width modulation control unit by a control unit; the step of modulating a reference current based on the first control signal and the data signal, and converting the reference current into a plurality of current setting signals; the step of generating a pulse signal based on the second control signal and the data signal; the step of generating a continuous conduction time in the predetermined operation period using the driving current, based on the pulse signal and the current setting signals; and the step of driving the light emitting diode within the continuous conduction time.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

Figure 1A:
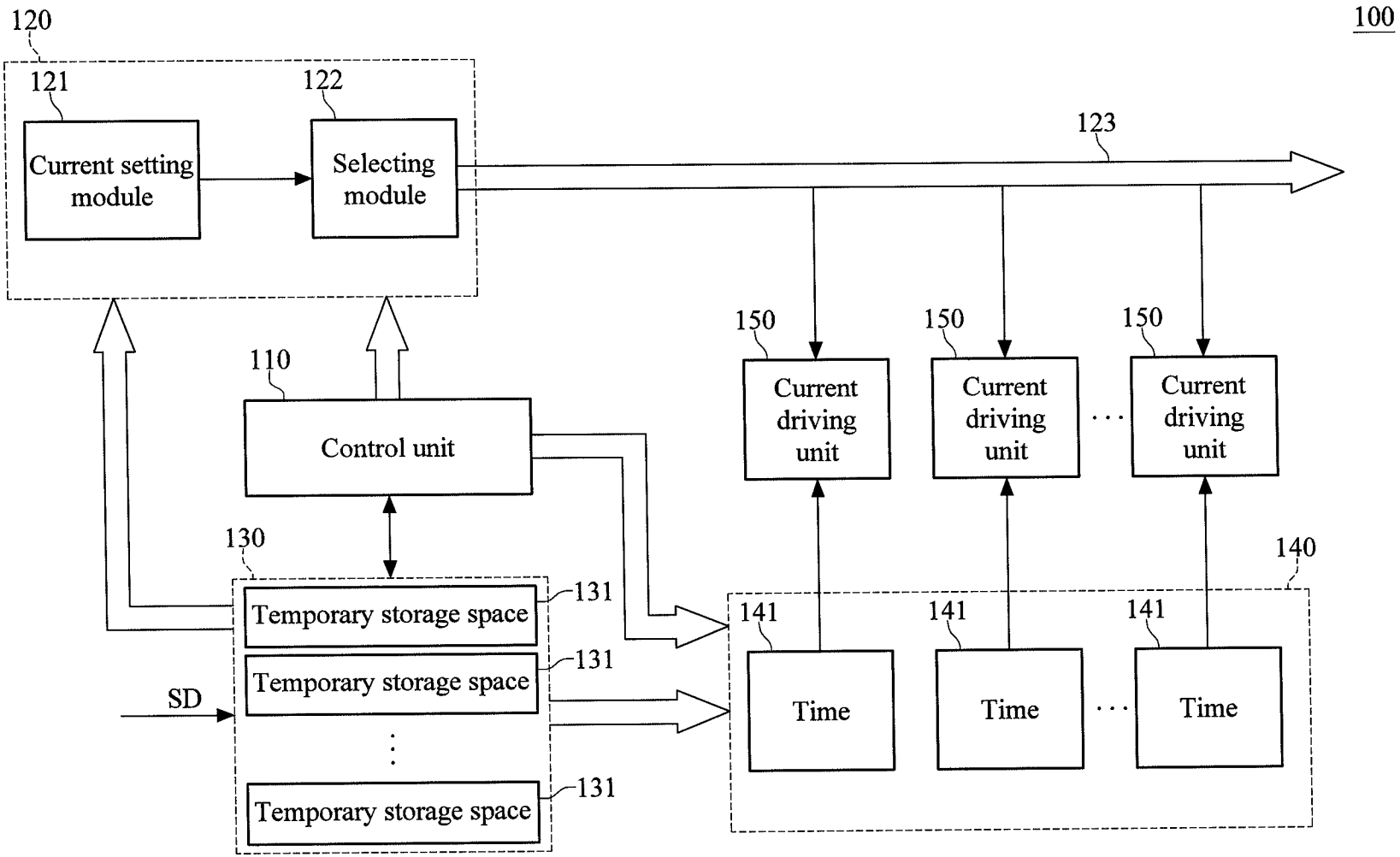
FIG. 1A is a structural illustration of a driving circuit of a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring to FIG. 1A, which is a structural illustration of a driving circuit of a first embodiment of the disclosure. A driving circuit 100 comprises a control unit 110, a current setting unit 120, a register 130, a pulse width modulation control unit 140 and a plurality of current driving units 150. A data signal SD is a sequence signal which has an N-bits brightness level data, wherein N is a constant. The brightness level data is expressed in a binary bit code A (h), wherein h is a constant from 0 to (N−1), and A (h) is 0 or 1.

The control unit 110 is connected to the current setting unit 120, the register 130 and the pulse width modulation control unit 140, for providing a first control signal to the current setting unit 120, providing a second control signal to the pulse width modulation control unit 140 and providing a third control signal to the register 130, in order to drive the current setting unit 120, the register 130 and the pulse width modulation control unit 140. The first control signal, the second control signal and the third control signal are ON period and OFF period periodic pulse signals for counting.

The register 130 is connected to the control unit 110, the current setting unit 120 and the pulse width modulation control unit 140. A plurality of temporary storage spaces 131 is provided by the register 130 for receiving and storing a plurality of the data signals SD in series. And the register 130 may sent the data signal SD stored in each of the temporary storage spaces 131 to the current setting unit 120 and the pulse width modulation control unit 140 in series, according to the third control signal sent by the control unit 110, each of the data signals SD is corresponded to one of the light emitting diodes (not illustrated in the drawing).

The current setting unit 120 is connected to the control unit 110 and the current driving units 150 for receiving a reference current, the first control signal and each of the data signals SD. The current setting unit 120 comprises a current setting module 121 and a selecting module 122. The current setting module 121 sets the type of current level value required by the driving circuit 100 based on the data signals SD and the first control signal, so that the reference current is converted into a plurality of current setting signals with different level values respectively by the selecting module 122 based on the setting, and then the current setting signals required are further selectively outputted to each of the current driving units 150 (for example, by the signal bus 123 as shown), so as to further form the driving currents corresponding to each of the light emitting diodes respectively.

The pulse width modulation control unit 140 is connected to the control unit 110, the register 130 and each of the current driving units 150. The pulse width modulation control unit 140 is operated with the control unit 110 and the current setting unit 120 synchronously, to receive the second control signal sent by the control unit 110 and each of the data signals SD sent by each of the temporary storage spaces 131. Then the modulation control unit 140 further counts the data in each of the data signals SD received based on the controlling of the second control signal, in order to generate a corresponding pulse signal to be sent to one of the corresponding current driving units 150. The pulse width modulation control unit 140 comprises a plurality of timers 141, and each of the timers 141 is corresponded to one of the temporary storage spaces 131, one of the current driving units 150 or a light emitting diode respectively for counting the data in the data signals SD.

Lastly, each of the corresponding driving currents is formed by the current driving units 150 based on each of the pulse signals and the current setting signals received. Because the data signals SD are binary codes, in its predetermined operation period, each of the driving currents has a plurality of time intervals corresponding to the difference from the most significant bits to the least significant bits, and a continuous conduction time is included in the predetermined operation period.

Figure 1B:
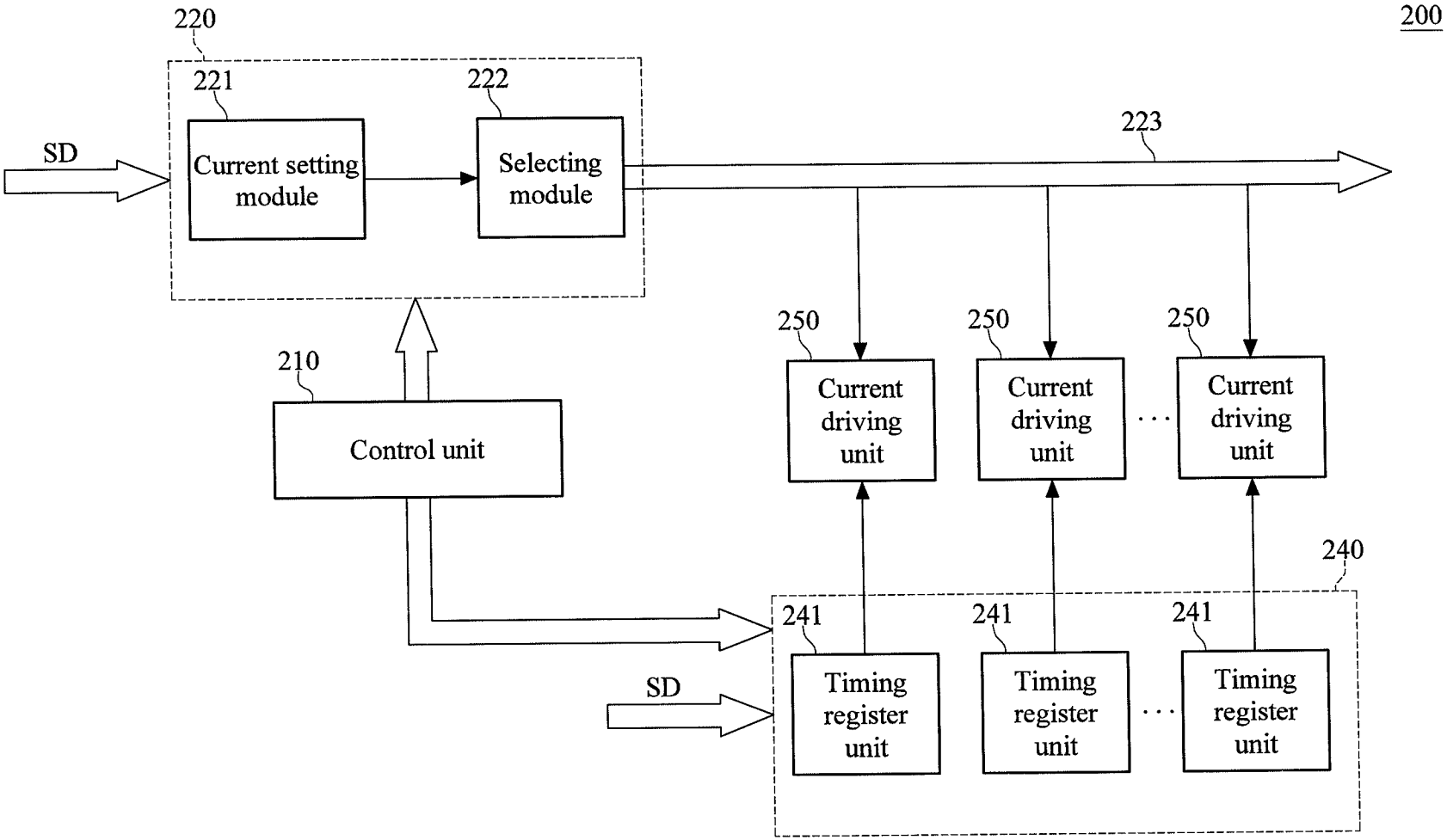
FIG. 1B is a structural illustration of a driving circuit of a second embodiment of the disclosure.

Furthermore, the disclosure further provides a second embodiment as shown in FIG. 1B, which is a structural illustration of the driving circuit of a second embodiment of the disclosure. The differences between a driving circuit 200 in the second embodiment and the driving circuit 100 in the first embodiment lie in that: the function of computing and the function of data temporary storing are integrated into a pulse width modulation control unit 240, for example, each of timing register units 241 as shown. Therefore, the data signals SD can be stored directly in the timing register units 241 temporarily, and the data stored temporarily in the timing register units 241 is counted.

Figure 2A:
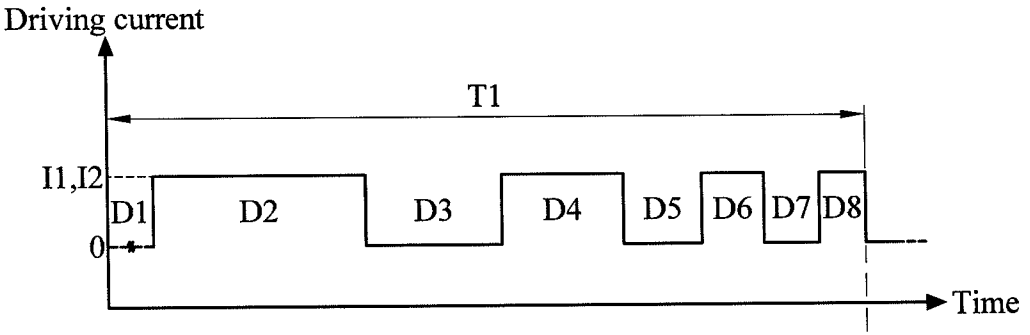
FIG. 2A is a time-sequential chart of a driving current of the first embodiment of the disclosure.
Figure 2B:
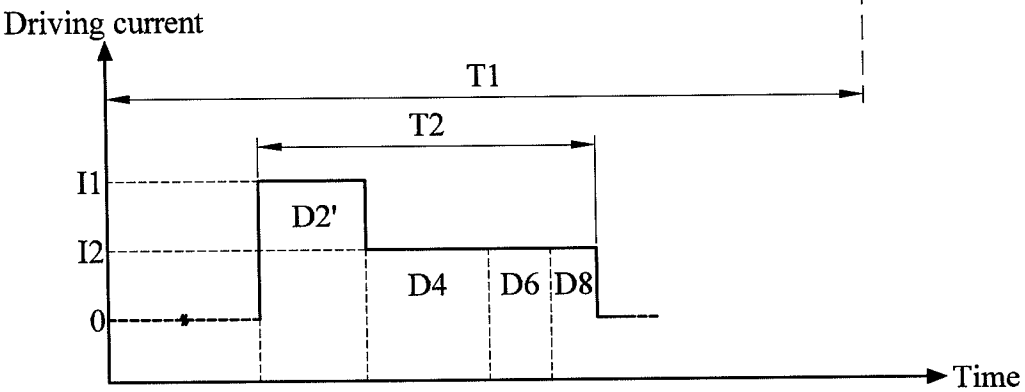
FIG. 2B is a time-sequential chart of a driving current of the first embodiment of the disclosure.

For further describing how to form the driving currents having a continuous conduction time in the predetermined operation period for further driving each of the light emitting diodes, please refer to FIGS. 1B, 2A and 2B. FIGS. 2A and 2B are timing diagrams of a driving current of the first embodiment of the disclosure. In an embodiment of the disclosure, assume that the data signal SD is a serial signal and comprises a 8-bits brightness level data, and the binary code of the brightness level data is 10101101, i.e. from the left to right the most significant bit A(7) is 1, an effective bit code A(6) is 0, an effective bit code A(5) is 1 and so on until the least significant bit code A(0) is 1. [describe→description]

More specifically, the ON period ones (i.e. the effective bit code is 1) indicates that the current setting signals are provided for the current driving units 250 within the corresponding time intervals, so that the driving currents are generated correspondingly by the current driving units 250 based on the pulse signals provided by the timing register units 241, for driving the light emitting diodes, wherein this type of time interval is conduction interval. The OFF period ones (i.e. the effective bit code is 0) indicates that the current setting signals are not provided for the current driving units 250 within the corresponding time intervals, so that the light emitting diodes can not be driven, wherein this type of time interval is non-conduction interval.

When the data signals SD are received by a current setting unit 220, an current setting module 221 sets the level values of the current setting signals required by the driving circuit 200 based on the brightness level data of each bit in the data signals SD and the first control signal, so that a reference current is converted into a plurality of current setting signals with different level values respectively, as shown in a signal bus bar 223, by a selecting module 222 based on the setting, and at least one of the current setting signals selected is further outputted to each of the current driving units 250.

When the received data signals SD are stored temporarily by each of the timing register units 241, each brightness level data of the data signals SD is also counted at the same time, so that the outputted pulse signals are formed as a plurality of time intervals (e.g. D1 to D8 as shown in FIG. 2) corresponding from the most significant bit to the least significant bit. The most significant bit A (7) is corresponded to the time interval D2, the effective bit A (6) is corresponded to the time interval D1, the effective bit A (5) is corresponded to the time interval D3 and so on. The length of each of the time intervals is related to the second powers of the corresponding effective bit, and a predetermined operation period T1 is the sum of each of the time intervals.

Then, corresponding current setting signals are selectively outputted to the corresponding current driving units 250 by the current setting unit 220 using a means for modulating current provided according to the driving circuit 200 and by the selecting module 222 based on different current level values required in each of the time intervals. The received pulse signals are corresponding to the received current setting signals by the current driving units 250 based on the current modulation, so as to output the driving currents. At least one of the time intervals with a longer period is selected by the means for current modulation, and a current setting signal with a higher level value is outputted to the corresponding current driving unit 250 by the selecting module 222 in the time interval, so that the period is reduced. If the level value of the selected corresponding current setting signal is double of that of other conduction intervals, the period of the time interval is changed to half of the original. In an embodiment of the disclosure, in the time intervals D1 and D2 corresponding to the pre-selected most significant bit and its adjacent effective bit, the driving current of the selected time interval D2 is changed to two times of the original by using the means for current modulation, and the time intervals D3 to D8 corresponding to the other effective bits are maintained in a level value I2 as shown in FIG. 2B.

Then, the conduction intervals with ON levels, such as the time intervals D2, D4, D6 and D8, are selected and integrated by using a selection and integration mechanism provided by the control unit 210, so that a continuous conduction time T2 is generated by integrating the conduction intervals, therefore the driven light emitting diode can be conducted continuously in the predetermined operation period T1. In the continuous conduction time T2, because the conduction time and the level values of the conduction intervals are different, light with different brightness levels is emitted by the light emitting diode.

According to each of the embodiments provided by the disclosure, even though the data signals are defined as binary codes, it should not be construed as a limitation to the disclosure, and the data signals can be other forms of digital signals such as octal bits digital signals or hexadecimal bits digital signals. Furthermore, the multiple of the corresponding current level values in each of the conduction intervals or the multiple of the length of the conduction time are not limited by the embodiments, therefore the multiple can be an integer constant or a non-integer constant.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A driving circuit adapted to drive a light emitting diode by current modulation, comprising:

a control unit for providing a first control signal and a second control signal;

a current control unit connected to the control unit for converting a reference current into a plurality of current setting signals based on a data signal and the first control signal;

a pulse width modulation control unit connected to the control unit for outputting a pulse signal based on the data signal and the second control signal; and a current driving unit connected to the pulse width modulation control unit for driving the light emitting diode based on a driving current, wherein the control unit is adapted to generate a continuous conduction time in a predetermined operation period based on the pulse signal and the current setting signals.

2. The driving circuit as claimed in claim 1, wherein the pulse width modulation control unit comprises a timing register unit for registering the data signal and outputting the pulse signal based on the counting of data in the data signal.

3. The driving circuit as claimed in claim 1, wherein the data signal is a binary code or a digital signal of other number systems.

4. The driving circuit as claimed in claim 3, wherein the current control unit converts the reference current into the current setting signals based on the binary code, and each of the current setting signals has a corresponding level value.

5. The driving circuit as claimed in claim 4, wherein the current control unit comprises a current setting module and a selecting module, wherein based on the data signals, the current setting module is adapted to enable the selecting module to generate the current setting signals and is adapted to selectively provide one of the corresponding current setting signals to the current driving unit.

6. The driving circuit as claimed in claim 3, further comprising:

a current modulation mechanism for dividing each of the driving currents, from the most significant bit to the least significant bit, into a plurality of time intervals based on each of the pulse signals and each of the current setting signals, wherein each of the time intervals is a conduction interval or a non-conduction interval.

7. The driving circuit as claimed in claim 6, wherein the current modulation mechanism is adapted to select at least one of the conduction intervals from the time intervals and multiplies a level value of the selected conduction interval by a multiple value.

8. The driving circuit as claimed in claim 6, wherein the current modulation mechanism is adapted to select at least one of the conduction intervals and divide a conduction time of the selected conduction interval decreased by a multiple value.

9. The driving circuit as claimed in claim 6, wherein in each of the conduction intervals, the current modulation mechanism is adapted to allow a selecting module of the current control unit to selectively allocate one of the current setting signals to the current driving unit.

10. A driving method for forming a driving current as a plurality of conduction intervals and a plurality of non-conduction intervals based on a plurality of bit codes from the most significant bit to the least significant bit of a data signal, and driving a corresponding light emitting diode in a predetermined operation period, the driving method comprising:

inputting the data signal;

sending a first control signal to a current control unit and a second control signal to a pulse width modulation control unit by a control unit;

modulating a reference current based on the first control signal and the data signal, and converting the reference current into a plurality of current setting signals;

generating a pulse signal based on the second control signal and the data signal;

generating a continuous conduction time in the predetermined operation period using the driving current, based on the pulse signal and the current setting signals; and driving the light emitting diode within the continuous conduction time.

11. The driving method as claimed in claim 10, further comprising:

selecting each of the conduction intervals and integrating the selected conduction intervals into a continuous conduction interval in the predetermined operation period.

12. The driving method as claimed in claim 11, further comprising:

selecting at least one of the conduction intervals and multiplying a level value of the selected conduction interval by a multiple value.

13. The driving method as claimed in claim 11, further comprising:

selecting at least one of the conduction intervals and dividing a conduction time of the selected conduction interval by a multiple value.

14. The driving method as claimed in claim 10, wherein the pulse signal is generated by timing the data in the data signal by the pulse width modulation control unit.

15. The driving method as claimed in claim 10, wherein the data signal is a binary code or a digital signal of other number systems.

16. The driving method as claimed in claim 10, further comprising:

selecting one of the current setting signals in each of the conduction intervals based on the data signal, to form the driving current, wherein the current setting signals have different level values respectively.

* * * * *